US005287870A

United States Patent [19]

Rhodes

[11] Patent Number: 5,287,870

[45] Date of Patent: Feb. 22, 1994

[54] WALKING AID

[76] Inventor: H. A. G. Rhodes, Moor Crag 2, Ghyll Head Windermere LA23 3LW, United Kingdom

[21] Appl. No.: 773,958

[22] PCT Filed: Mar. 22, 1990

[86] PCT No.: PCT/GB90/00437

§ 371 Date: Nov. 20, 1991

§ 102(e) Date: Nov. 20, 1991

[87] PCT Pub. No.: WO90/11031

PCT Pub. Date: Oct. 4, 1990

[30] Foreign Application Priority Data

Mar. 23, 1989 [GB] United Kingdom ..... 8906865

[51] Int. Cl.[5] ..... A61H 3/02

[52] U.S. Cl. ..... 135/72; 135/65; 280/821; D8/DIG. 6

[58] Field of Search ..... 135/65, 68, 75, 74, 135/77, 72, 76, 84; 280/821, 822; D8 DIG. 6

[56] References Cited

U.S. PATENT DOCUMENTS

| | | | |
|---|---|---|---|
| 624,207 | 5/1899 | Hawley, Jr. | 135/84 |
| 3,085,814 | 4/1963 | Scott . | |
| 3,995,650 | 12/1976 | DiVito | 135/72 |
| 4,111,444 | 9/1978 | Clements, Jr. | 135/66 X |
| 4,196,742 | 4/1980 | Owen, Jr. | 135/75 X |
| 4,613,156 | 9/1986 | Lajos | 280/821 |
| 4,616,668 | 10/1986 | Battiston | 135/75 |

FOREIGN PATENT DOCUMENTS

| | | | |
|---|---|---|---|
| 688541 | 2/1940 | Fed. Rep. of Germany | 135/72 |
| 2310986 | 9/1974 | Fed. Rep. of Germany | 135/72 |
| 1101212 | 10/1955 | France | 135/72 |
| 1112170 | 3/1956 | France | 135/72 |
| 2517551 | 12/1981 | France . | |
| 2516363 | 9/1982 | France . | |
| 2609639 | 1/1987 | France . | |
| 675275 | 7/1952 | United Kingdom . | |

*Primary Examiner*—Carl D. Friedman
*Assistant Examiner*—Lan C. Mai
*Attorney, Agent, or Firm*—Sheridan Ross & McIntosh

[57] ABSTRACT

A walking aid (10) which comprises an elongate shaft (12) having a handle (14) at or near its upper end, characterised in that the handle is inclined at an angle ($\alpha$) to the axis of the shaft and comprises a central column (24) adapted to be held by the hand, the column having toward the lower portion thereof a laterally extending platform (26) capable of supporting the ulnar border of the hand. The handle is gripped downwardly, in a similar manner to a pistol grip, and the inclination of the handle to the shaft ensures that the wrist can be maintained in its neutral position which involves least strain to the user. The angle ($\alpha$) can be adjusted according to patient needs by providing a pivot mounting (22) and a relevant lock between shaft and handle.

18 Claims, 5 Drawing Sheets

WALKING AID

This application is the U.S. National Phase of PCT/GB90/00437, filed Mar. 22, 1990.

This invention relates to a walking aid.

Help with walking would be beneficial to persons of all ages in a wide variety of circumstances. Illness or infirmity can make walking unaided difficult or impossible. Apart from convenience in getting about, walking is excellent exercise and it is therefore doubly important to remove or reduce disincentives to walking, or indeed provide an opportunity to enhance performance, while keeping a natural upright posture.

The traditional aid for walking is a walking stick. Even when properly fitted to the user as regards length, a walking stick is not satisfactory. It impairs the normal walking action, requires a considerable amount of strength in the arm and, in particular, in the grip, and pressure through the palm of the hand is a source of discomfort. Since the user of a walking stick may often be in poor general health in any event, the necessary strength of grip may be lacking.

The invention seeks to provide a walking aid improved in the above respects.

According to the present invention there is provided a provided a walking aid which comprises an elongate shaft having a handle at or near its upper end, characterised in that the handle is inclined at an angle to the axis of the shaft and comprises a central column adapted to be held by the hand, the column having toward the lower portion thereof a laterally extending platform capable of supporting the ulnar border of the hand, a further platform or ledge provided toward the upper portion of the column and on the opposite side from the platform to support the thenar eminence extending along the thumb margin such that, in use, the plane of the thumb metacarpal is at right angles to that of the remaining metacarpals.

The invention seeks to provide a walking aid which is adapted to be gripped 'downwardly' and thus allows the forearm to take up a position with the wrist joint lying such that the palm is vertical and in line with the forearm, thus in the position of least strain. The arm swings in this position and the elbow joint and arm muscles can efficiently contribute to the normal walking pattern of the lower limbs and can contribute effectively to forward propulsion.

An object held in the hand with the forearm in the horizontal position, the palm vertical and wrist lying straight would naturally incline forwards to an angle of approximately 15 degrees. With the forearm in this position the most appropriate location for the base of the stick is a position directly below the centre of the hand. Accordingly it is preferred that the handle is inclined to the shaft at an angle of about 15° or more.

It has been established that the optimum position of the forearm for any particular individual will vary according to their physical condition. The forearm position preferably lies between the horizontal and an angle of about 35 degrees below horizontal, preferably toward the latter. In general the weaker an individual is the more near vertical the forearm requires to be, as they need to transfer more load into the walking aid and demand a greater stabilising effect. Furthermore the physical size of the user varies considerably and this factor must be compensated for. Thus by ensuring that the handle is at an angle to the shaft, the base of the shaft can be in a position directly beloe the centre of the hand. The aid is gripped 'downwardly', that is in a very similar way to a pistol grip, with the shaft extending from the bottom of the fist rather than the top. Thus, a shaft/handle angle of about 15° would be appropriate for use with the elbow at or near the horizontal, and a greater angle would be required for a shorter shaft approximately in proportion to the angle of declination of the elbow. For example, if a shaft length involving an elbow declination of 25° was chosen, the handle angle might be approximately 40° to the shaft.

The aid should be of such a length that it is below the elbow height of the user, for optimum ease of use. The more vertical support the user needs, the shorter the aid can be and accordingly the greater the angle between the handle and the shaft to retain the correct hand/-wrist/forearm geometry. Conversely, if the user requires more horizontal thrust for propulsion, the aid will be relatively longer, and the handle/shaft angle correspondingly less. Similarly the angle will be decreased if a greater stride length is desired.

For a particular user the shaft length and handle angle should be tailored to suit physical characteristics and support/thrust needs. In any event the mid-line of the hand should be kept in line with the forearm, i.e. the wrist should be in its neutral position.

The walking aid of the invention may be fitted to a patient or user and then fixed in length/angle, but preferably it has both angular and height adjustment which enable it to be set to the correct configuration for any given individual and subsequently re-set to meet changing circumstances. The following characteristics are desirably:

1. Forearm held relaxed, approximately 20° below the horizontal position;
2. Palm vertical, wrist held straight in line with forearm;
3. Base of shaft in contact with ground directly below the centre of the hand.

In order that the device can be accurately fitted to the user, it is preferred that the shaft is adjustable as to length. Furthermore, the angle made between the handle and the shaft may also be adjustable so that the device may be fitted very closely to a given user in order that the base of the shaft should contact the ground below the hand.

Preferably the platform is provided with an upturned edge or flange so that the ulnar border of the hand is both supported and partially cradled. Advantageously, the platform extends around the column for a sufficient length also to support the fifth digit. Also, it is advantageous for the platform to extend backwards to support the heel of the hand. In addition there is provided, toward the upper portion of the column and on the opposite side from the platform, a further platform or ledge to support the thenar eminence extending along the thumb margin. At rest the plane of the thumb metacarpal is at right angles to that of the remaining metacarpals, and so the thumb support ledge is placed appropriately.

Advantageously, the upper portion of the column widens out to provide an enlarged portion which greatly assists in preventing the handle slipping through the grip and enables the handle to be held securely with a minimum of force being exerted.

The walking aid and handle of the invention should be constructed of strong but light materials such as light alloy and/or plastics materials, and the handle is preferably moulded from plastics material.

The walking aid of the invention is preferably fitted at its foot with a rubber ferrule. The latter is preferably shaped so as to provide a flat surface from side to side but an essentially curved surface from front to back to aid the walking motion as will be described more fully hereinafter.

The invention will be described further, by way of example, with reference to the accompanying drawings, in which.

Figure 1:
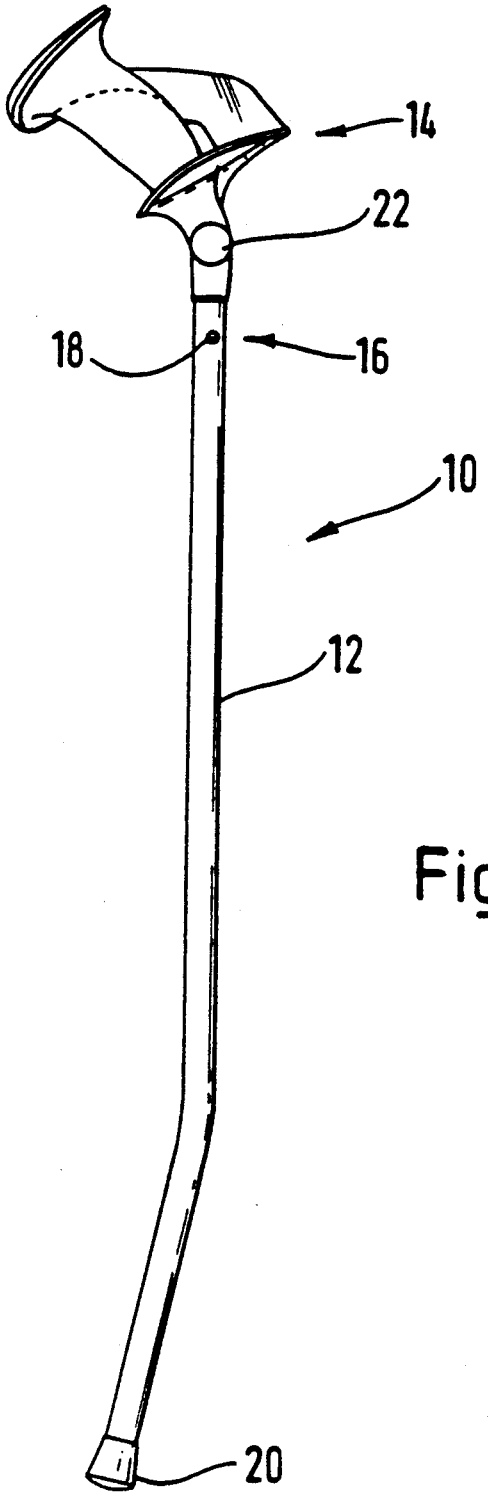
FIG. 1 is a side view of a device in accordance with the invention for use with the left hand.

Referring to the drawings, and in particular FIG. 1, a walking aid generally designated 10 comprises a shaft 12 having a handle 14 affixed to its upper end. The shaft 12 includes a portion 16 which is telescopically extendable and screw means 18 are provided to lock the shaft 12 thus determining the overall height of the device. The base of the shaft 12 carries a ferrule 20, described more fully hereinafter with reference to FIGS. 7 & 8.

The handle 14 is pivotally mounted at 22 so that its angle relative to the axis of the shaft 12 is adjustable. The pivotal mounting 22 includes means for locking the handle 14 in relation to the shaft 12 when the correct angle has been set.

It can be seen from FIG. 1 that the lower portion of the shaft 12 of the embodiment illustrated is cranked forwards. This provides aesthetic appeal as the line of the shaft follows closely the line of the leg.

Referring now to FIGS. 2 to 6, the handle 14 comprises a central column 24 capable of being held in the hand. The handle illustrated is adapted to take a right hand; a left hand handle would be a mirror image of this. Toward the lower end of the column 24 there is provided a platform 26 having a slightly upturned edge portion 28. On the opposite side of the column 24, toward the upper end thereof, is provided a further ledge 30. The top of the column 24 swells out to provide a thickened portion 32.

Figure 2:
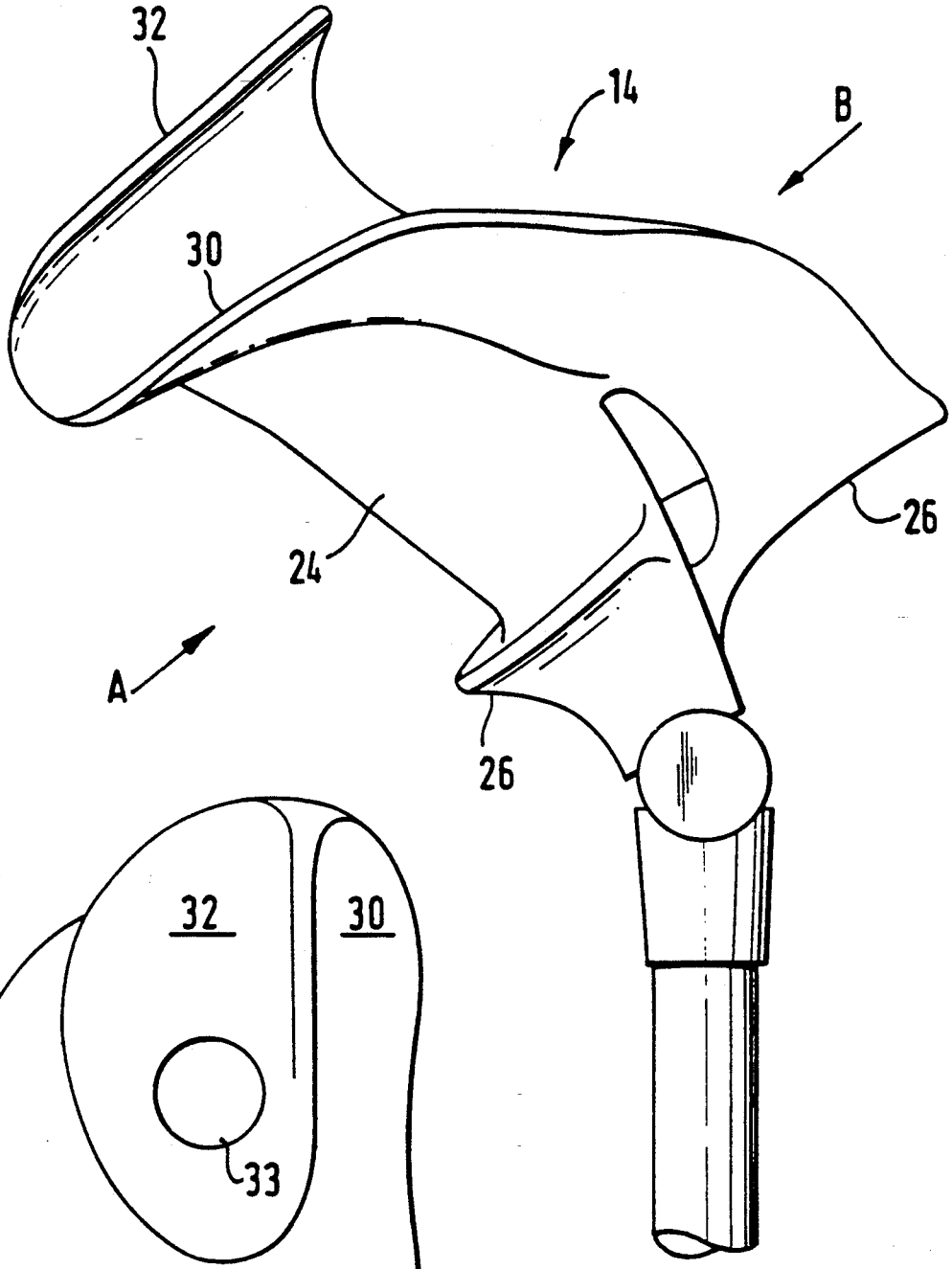
FIG. 2 is an enlarged view of the handle of the device for use with the right hand.

The handle is gripped with the extended hand entering in the direction of arrow B in FIG. 2 with the fingers curled around the back of the column 24, the ulnar border of the hand resting on the platform 26, and the thumb resting on the ledge 30. The thickened portion 32 helps prevent the handle slipping out of the grasp without requiring any great strength of grip.

As illustrated in the drawings, it may well be preferable to extend the ledge 26 around the periphery of the column so that it provides a support of the hypothenar eminence (fifth metacarpal) extending along the medial (ulnar) border of the fifth digit. In addition, the ledge extends backwards (to the right as viewed in FIG. 2) to provide support to the heel of the hand. With this configuration the hand will remain in place even if the grip is relaxed.

Figure 6:
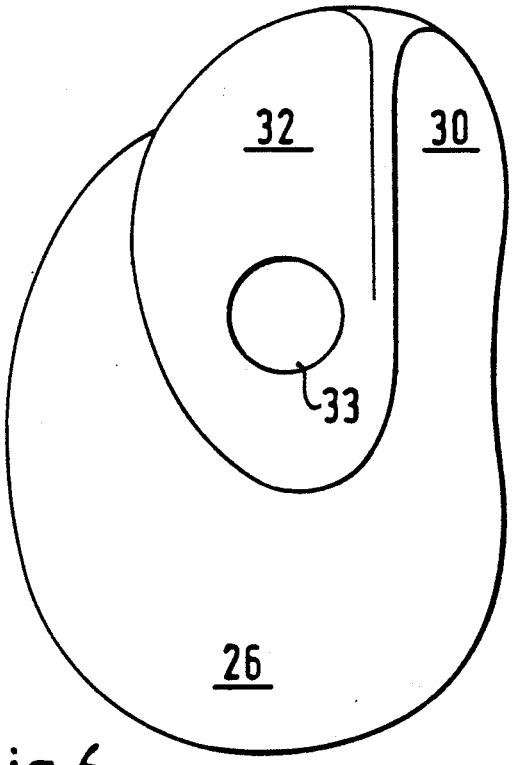
FIG. 6 is a top plan view of a left hand handle.
Figure 3:
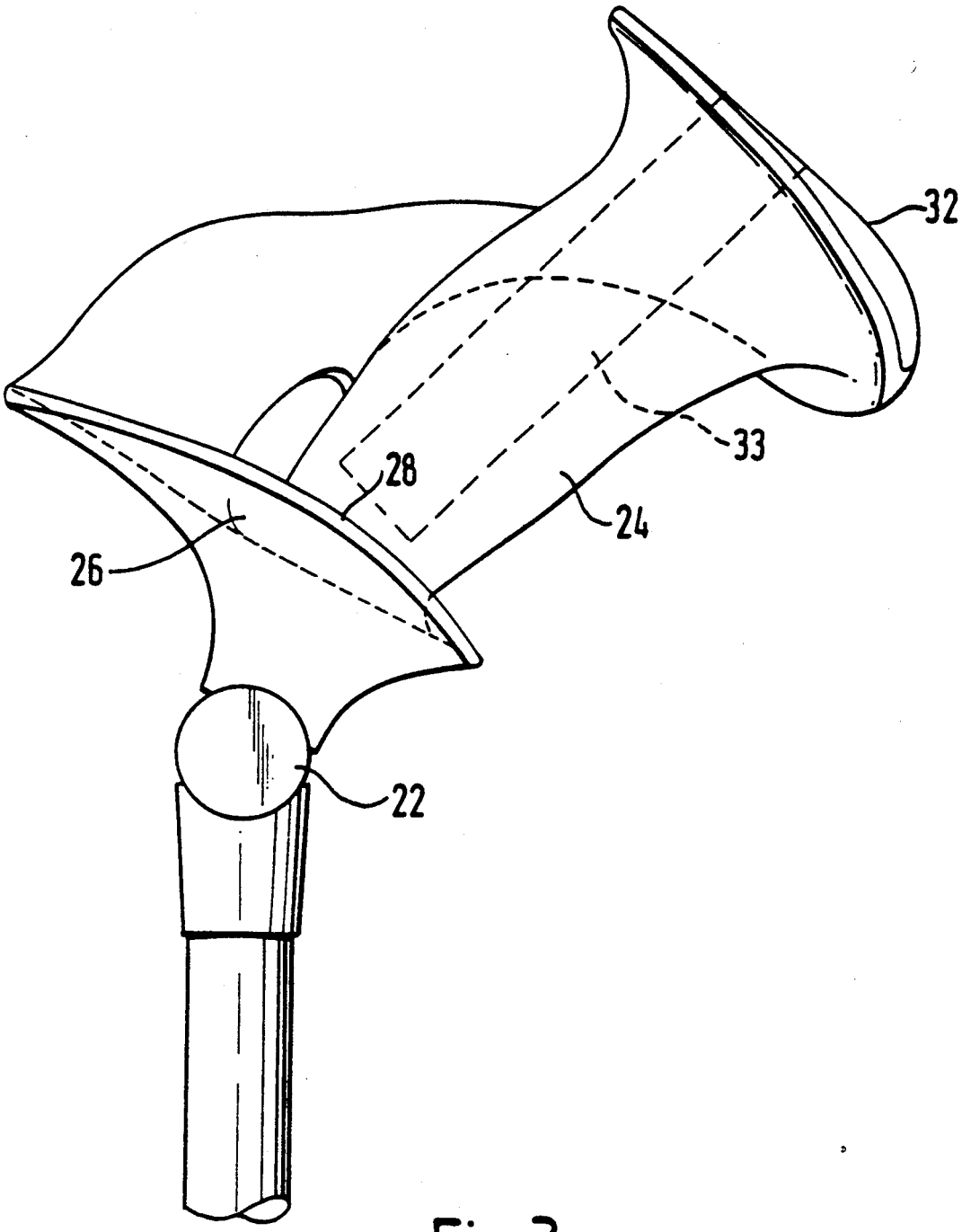
FIG. 3 is a similar view to FIG. 2 from the opposite side.
Figure 4:
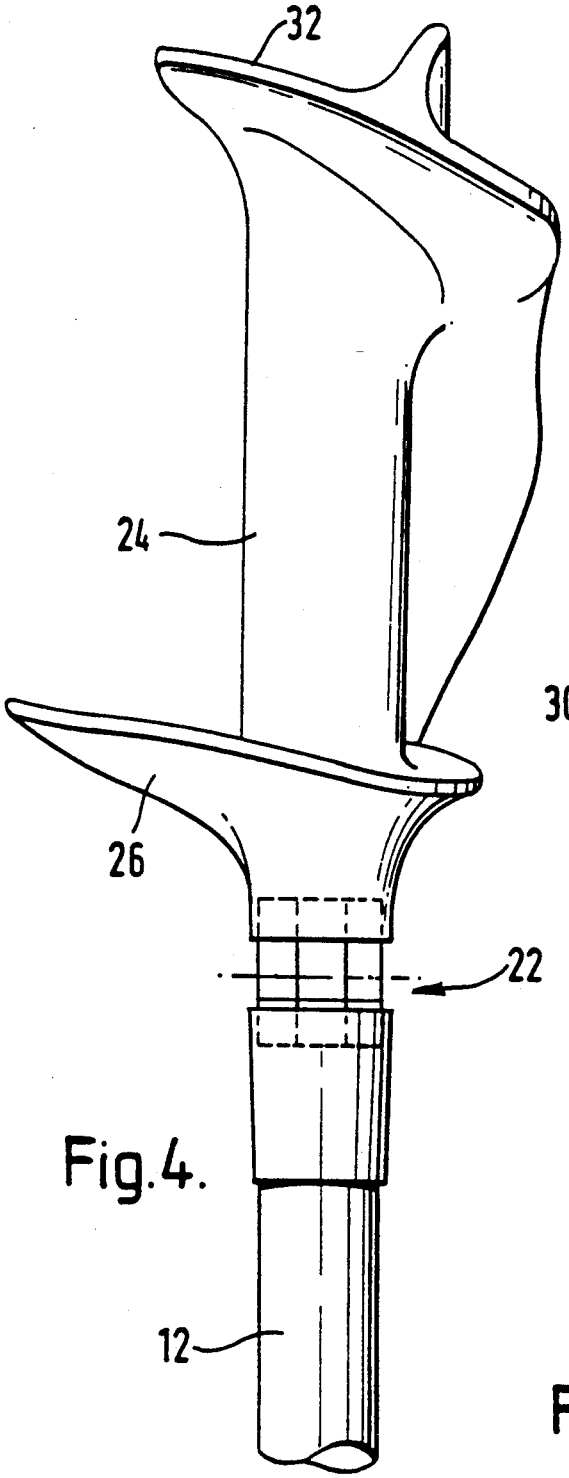
FIG. 4 is a view of the handle in the direction of arrow A in FIG. 2.
Figure 5:
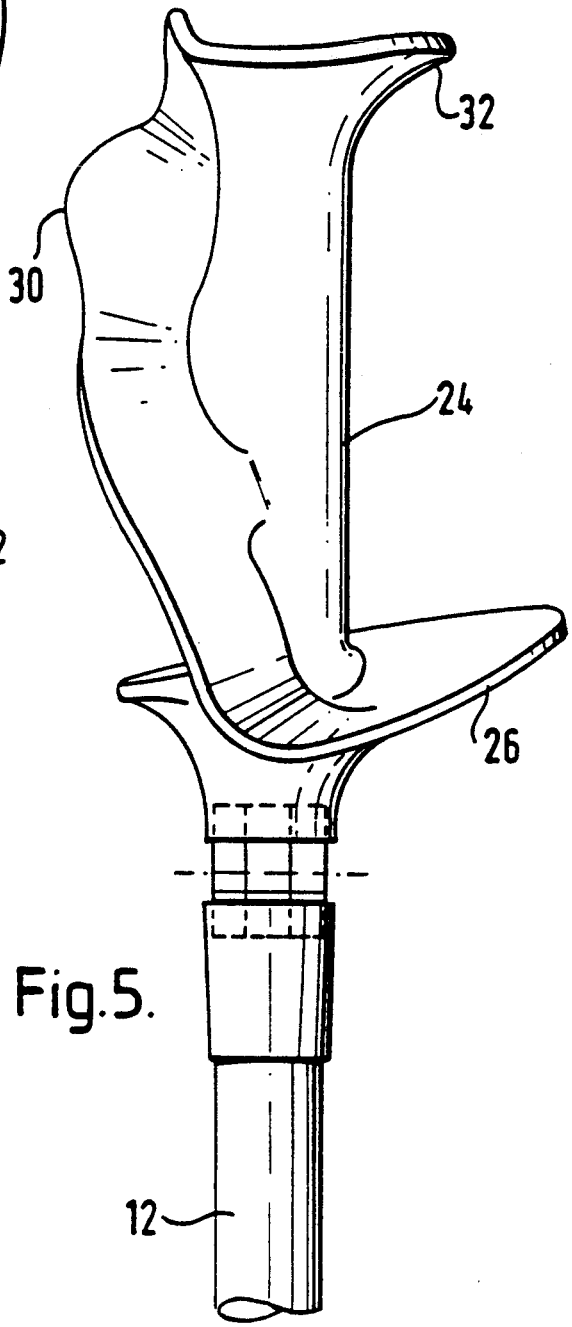
FIG. 5 is a view of a handle in the direction of arrow B in FIG. 2.

As can be seen from FIG. 6, the central column 24 can be made hollow with a cavity 33. This can be used to house, e.g., an alarm or warning device actuated by a button (not shown) at the top adjacent the thumb rest 30 for easy access in case of emergency.

Figure 7:
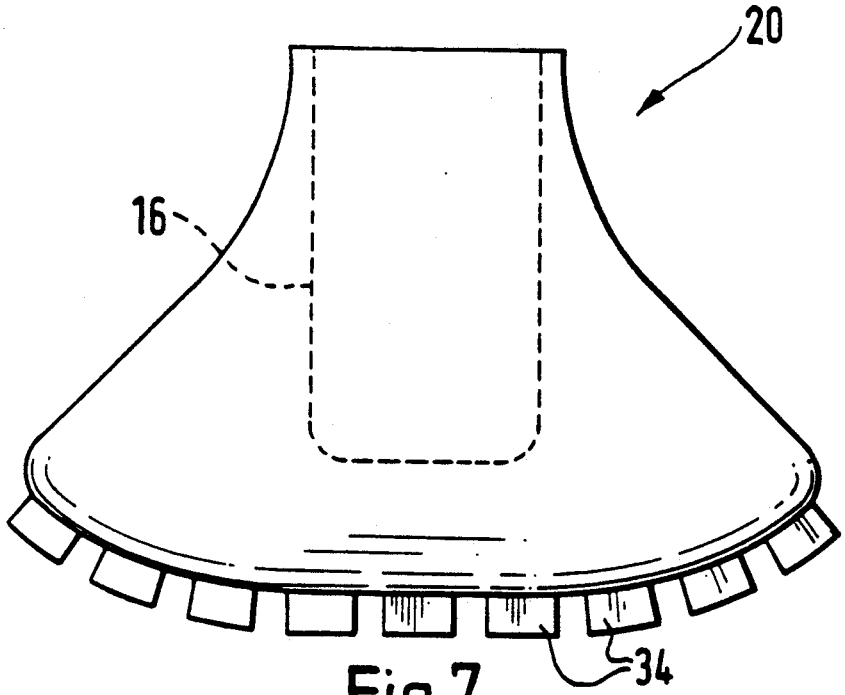
FIG. 7 is a side view of the ferrule on an enlarged scale.
Figure 8:
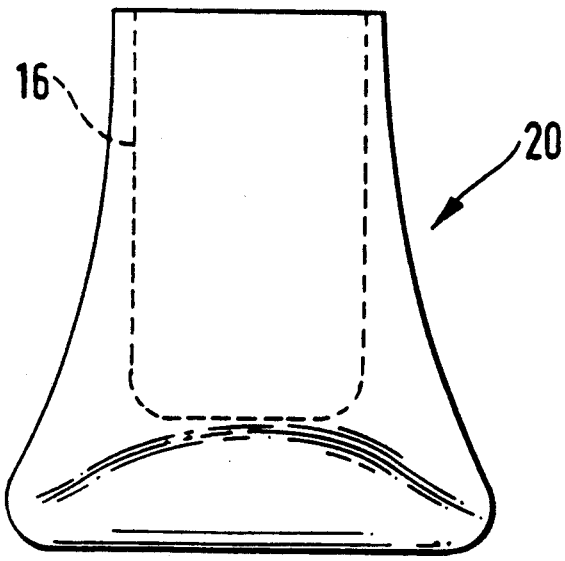
FIG. 8 is an end view of the ferrule.

The ferrule 20 is made of a resilient durable and anti-skid material such as rubber and is preferably provided with corrugations or knobs 34 on its base to aid grip. Although a circumferentially symetrical ferrule may be employed, the ferrule 20 is preferably essentially flat from side to side (FIG. 8) but is rounded at both leading and trailing edges in the front to back direction (FIG. 7). The purpose of this is to assist the walking action in that when the aid is placed on the ground ahead of the walker the rounded trailing edge is the first to contact the ground, in a similar manner to the heel of the foot. As the walker moves forward the shaft 12, 16 moves to the upright position and the essentially flat central area of the base contacts the ground giving good support. As the walker continues forward and the aid tilts to the right as viewed in FIG. 1, the rounded leading edge contacts the ground and enables the walker to 'push off' in a similar manner to the ball of the foot pushing off during the walking action. Since side to side stability is wanted, the base of the ferrule is essentially flat in this direction.

In use it is preferred that a pair of aids is provided, one for each hand. The walker grasps the handles 14 as described above. The height of the device 10 is such that the forearm from a bent elbow is up to 35 degrees below the horizontal, which position allows effort to be applied with the minimum of strain. The shorter the shaft, the greater the vertical support, but the shorter the stride; the longer the shaft (up to the position where the forearm is approximately horizontal), the greater the stride and horizontal thrust. The walker reaches forward with one device 10 and the opposite foot, transferring part of his weight to the device and part to the respective foot. This is repeated with the other device and other foot, and the whole process repeated in a smooth easy walking action. The device 10 remains in firm contact with the ground throughout this movement, and enables the user to 'push off' when the aid is at its rearmost point with respect to the user. This is in marked contrast to conventional walking sticks which are unstable and ineffective when their base is behind the user.

The device of the invention is significantly more effective in use than conventional walking sticks. It is also light in weight and inexpensive. Moreover the confidence it gives enables walking to be undertaken as an exercise for people who otherwise would not consider it. Far less grip is required than a conventional walking stick and the shape and angle of the handle ensure that this is at the most effective and comfortable position for use. The device is anatomically and biomechanically correct and thus promotes natural walking action.

I claim:

1. A walking aid, comprising an elongate shaft having a handle connected to an upper portion of said shaft, wherein said handle has a front and comprises a central column having an axis inclined in the direction of the front at an angle relative to an axis of said shaft, a first platform extending outwardly from a lower portion of said column, and a second platform extending from an upper portion of said column, wherein said first platform extends spirally about said column and connects to said second platform.

2. An aid as claimed in claim 1, wherein said handle is inclined relative to said shaft at an angle of at least 15°.

3. An aid as claimed in claim 2, wherein said handle is inclined relative to said shaft at an angle of up to 50°.

4. An aid as claimed in claim 1, wherein said handle angle is adjustable.

5. An aid as claimed in claim 1, wherein the length of said shaft is adjustable.

6. An aid as claimed in claim 1, wherein a lower portion of said shaft is cranked forwardly so that a base of said shaft contacts the ground substantially beneath said handle when a main portion of said shaft is held vertically.

7. An aid as claimed in claim 1, wherein said first platform comprises an upturned portion so that the user's wrist is maintained in its neutral position of least strain.

8. An aid as claimed in claim 1, wherein said first platform extends around said column for a sufficient length to support the fifth digit of the hand.

9. An aid as claimed in claim 1, wherein said first platform extends a sufficient distance from said column to support the heel of the hand.

10. An aid as claimed in claim 1, wherein said upper portion of said column is wider than said lower portion of said column.

11. An aid as claimed in claim 1, wherein said shaft comprises a plastic material.

12. An aid as claimed in claim 1, further comprising a rubber ferrule positioned on a lower portion of said shaft.

13. An aid as claimed in claim 12, wherein said ferrule is shaped so as to provide a substantially flat surface from side to side but an essentially curved surface from front to back to aid the walking motion.

14. An aid as claimed in claim 1, wherein said handle has a cavity to house a warning device.

15. An aid as claimed in claim 1, wherein said shaft comprises a metal.

16. An aid as claimed in claim 1, wherein said handle comprises a plastic material.

17. An aid as claimed in claim 1, wherein said second platform is oriented relative to said column such that the plane of the thumb metacarpal is at right angles to that of the remaining metacarpals when said aid is in use.

18. A walking aid comprising:

an elongate shaft adjustable with respect to height, said shaft having an upper and lower portion, said lower portion cranked forward;

a handle having a lower first platform and a second upper platform, said handle connected to said upper portion of said shaft and angularly adjustable with respect to said shaft said first platform extends spirally about said handle and connects to said upper platform;

a means for locking said handle in an angled position relative to said shaft, said locking means capable of being adjusted to maintain a user's wrist in a neutral position of least strain; and whereby a user of said walking device is able to transfer his weight to the device to promote a natural walking action.

* * * * *